US010888147B2

(12) United States Patent
Zhong et al.

(10) Patent No.: US 10,888,147 B2
(45) Date of Patent: Jan. 12, 2021

(54) COSMETIC CONTAINER

(71) Applicant: SHYA HSIN PACKAGING INDUSTRY (CHINA) CO., LTD., Kunshan (CN)

(72) Inventors: Hua Zhong, Kunshan (CN); Linglang Zhan, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 180 days.

(21) Appl. No.: 16/226,686

(22) Filed: Dec. 20, 2018

(65) Prior Publication Data

US 2019/0116961 A1 Apr. 25, 2019

Related U.S. Application Data

(63) Continuation-in-part of application No. PCT/CN2016/104484, filed on Nov. 3, 2016.

(30) Foreign Application Priority Data

Jun. 21, 2016 (CN) ..... 2016 1 0444709

(51) Int. Cl.
*A45D 40/10* (2006.01)
*A45D 34/00* (2006.01)
(Continued)

(52) U.S. Cl.
CPC ..... *A45D 40/10* (2013.01); *A45D 34/00* (2013.01); *A45D 40/222* (2013.01);
(Continued)

(58) Field of Classification Search
CPC ..... A45D 40/10; A45D 34/00; A45D 40/222; A45D 40/023; A45D 2034/002; A45D 2040/105; B05B 11/0038
See application file for complete search history.

(56) References Cited

U.S. PATENT DOCUMENTS 3,359,992 A * 12/1967 Cichek ..... A45D 34/042 401/101
5,352,054 A * 10/1994 Lhuisset ..... A45D 34/043 401/102

(Continued)

FOREIGN PATENT DOCUMENTS

CN 201384187 Y * 1/2010
CN 205795212 U * 12/2016

*Primary Examiner* — Nicholas D Lucchesi
(74) *Attorney, Agent, or Firm* — Matthias Scholl P.C.; Matthias Scholl

(57) ABSTRACT

A cosmetic container, including a tubular housing, an inner sleeve disposed in the tubular housing, and an elastic mechanism. The inner sleeve includes a first part, a second part, and a partition between the first part and the second part. The first part and the second part are disposed on the partition. The elastic mechanism is disposed between the first part of the inner sleeve and the inner wall of the tubular housing. The first part of the inner sleeve is a hollow structure and includes a limit column, an elastic column, and an axial gap between the limit column and the elastic column. The second part of the inner sleeve includes a tube adapting to accommodate cosmetics. The elastic column includes an outer surface facing the elastic mechanism, and the outer surface of the elastic column is provided with a first stopping point.

6 Claims, 12 Drawing Sheets

(51) Int. Cl.

| | |
|---|---|
| ***B05B 11/00*** | (2006.01) |
| ***A45D 40/22*** | (2006.01) |
| *A45D 40/02* | (2006.01) |

(52) U.S. Cl.
CPC ..... *B05B 11/0038* (2018.08); *A45D 40/023* (2013.01); *A45D 2034/002* (2013.01); *A45D 2040/105* (2013.01)

(56) References Cited

U.S. PATENT DOCUMENTS

| | | | | |
|---|---|---|---|---|
| 8,353,636 | B2 * | 1/2013 | Drugeon | A45D 40/10 401/107 |
| 8,851,330 | B1 * | 10/2014 | Chen | B65D 83/56 222/160 |
| 9,215,922 | B2 * | 12/2015 | Delage | A45D 40/0068 |
| 9,375,072 | B2 * | 6/2016 | Drugeon | A45D 40/26 |
| 2006/0285911 | A1 * | 12/2006 | Demellier | A45D 40/10 401/75 |

* cited by examiner

COSMETIC CONTAINER

CROSS-REFERENCE TO RELAYED APPLICATIONS

This application is a continuation-in-part of International Patent Application No. PCT/CN2016/104484 with an international filing date of Nov. 3, 2016, designating the United States, now pending, and further claims foreign priority benefits to Chinese Patent Application No. 201610444709.X filed Jun. 21, 2016. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

This disclosure relates to a press-type cosmetic container.

A conventional press-type cosmetic container includes a button, an outer cover, an inner cover, and a spring mechanism. The connection of the components is complex, and the production cost is relatively high.

SUMMARY

Disclosed is a press-type cosmetic container that has an improved structure.

The disclosure provides a cosmetic container, comprising a tubular housing, an inner sleeve disposed in the tubular housing, and an elastic mechanism. The inner sleeve comprises a first part, a second part, and a partition between the first part and the second part; the first part and the second part are disposed on the partition and extend axially towards two opposite directions; the elastic mechanism is disposed between the first part of the inner sleeve and an inner wall of the tubular housing; the first part of the inner sleeve is a hollow structure and comprises a limit column, an elastic column, and an axial gap between the limit column and the elastic column; the second part of the inner sleeve comprises a tube adapting to accommodate cosmetics; the elastic column comprises an outer surface facing the elastic mechanism, and the outer surface of the elastic column is provided with a first stopping point; the limit column comprises an outer surface facing the elastic mechanism, and the outer surface of the limit column is provided with a second stopping point; the elastic mechanism comprises an annular body, an elastic ring connected to the annular body, and a reset spring disposed in the first part and connected to an inner end surface of the tubular housing; the annular body and the elastic ring sleeve the limit column and the elastic column; the annular body comprises a first clamping point corresponding to the first stopping point of the elastic column and a second clamping point corresponding to the second stopping point of the limit column; the elastic ring comprises an elastic press point corresponding to the first stopping point; and the tabular housing comprises a button corresponding to the elastic press point of the elastic ring.

The tabular housing can comprise a first groove and the button can be disposed in the groove; the button can be connected of the tabular housing via a connection belt.

The first groove and the button can be square.

The hollow structure of the first part can be provided with an elastic limit part having a crisscross section, which facilitates the positioning of the reset spring.

The tube of the inner sleeve can comprise at least one pair of fixing points, and two sides of the at least one pair of fixing points can be provided with second grooves.

The first stopping point can be disposed on the outer surface of one end of the elastic column towards the inner end surface of the tubular housing, and the second stopping point can be disposed on the outer surface of one end of the limit column towards the inner end surface of the tubular housing.

Advantages of the press-type cosmetic container as described in the disclosure are summarized as follows. The button of the cosmetic container is integrated with the tubular housing. The cosmetic container has a simplified structure and is easy to operate.

Figure 1:
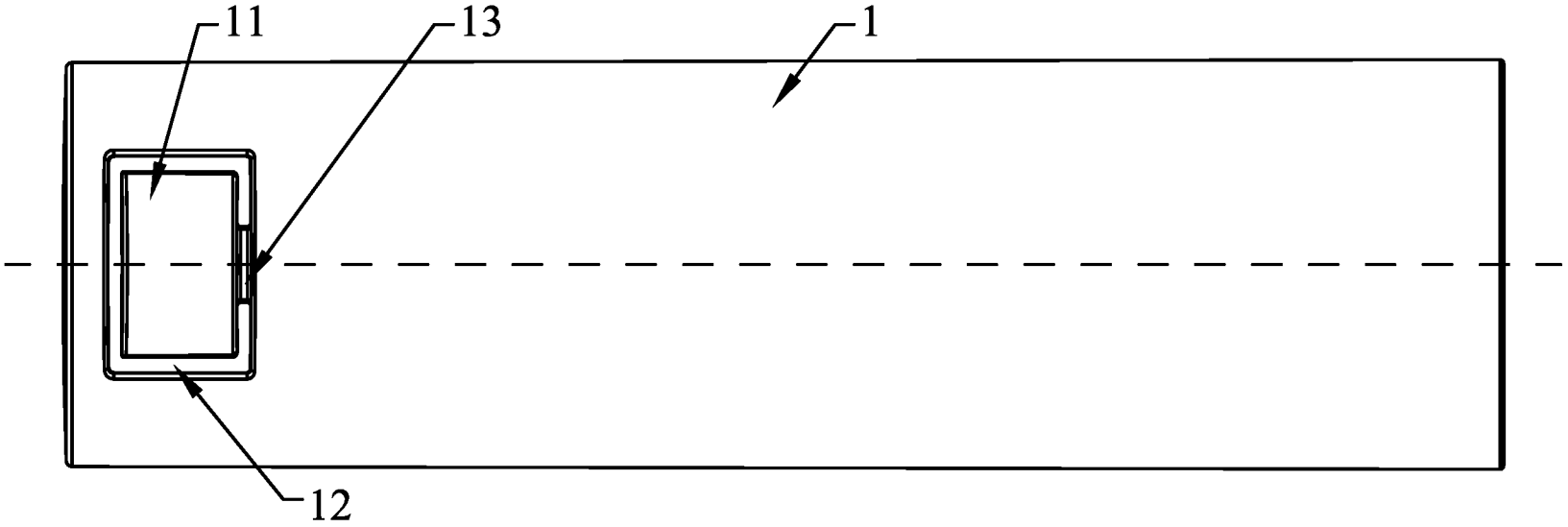
FIG. 1 is a schematic diagram of a button of a cosmetic container as described in the disclosure.
Figure 2:
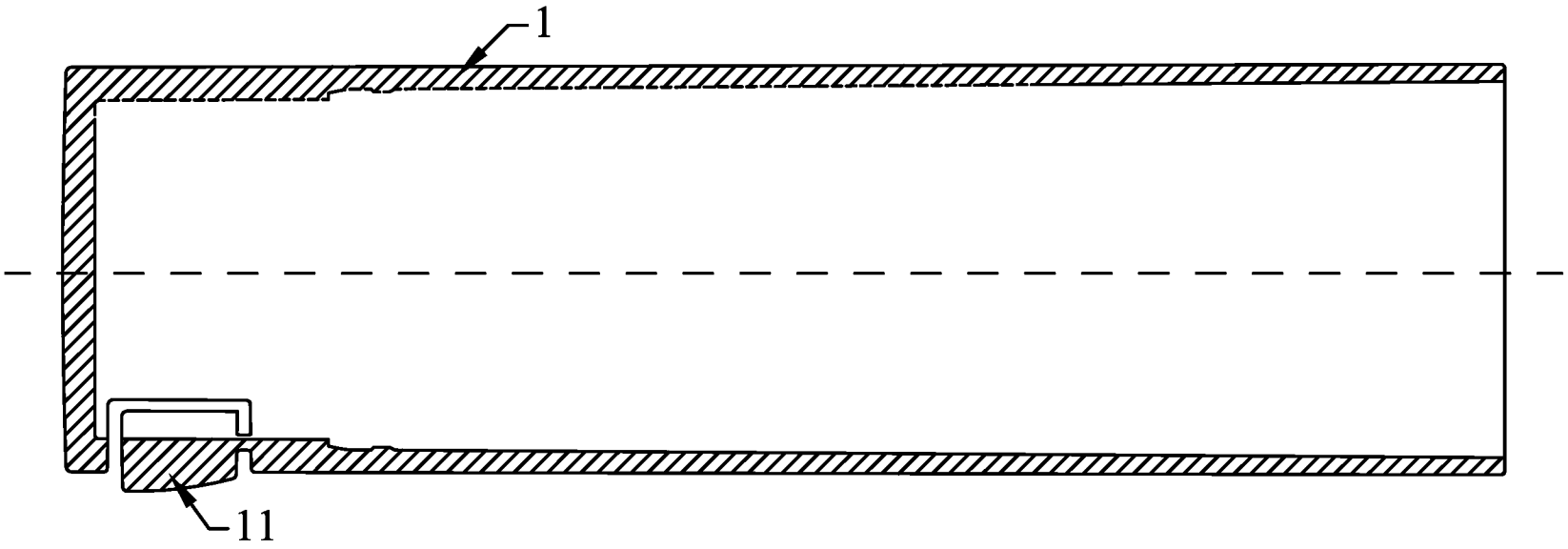
FIG. 2 is a sectional view of FIG. 1.
Figure 3:
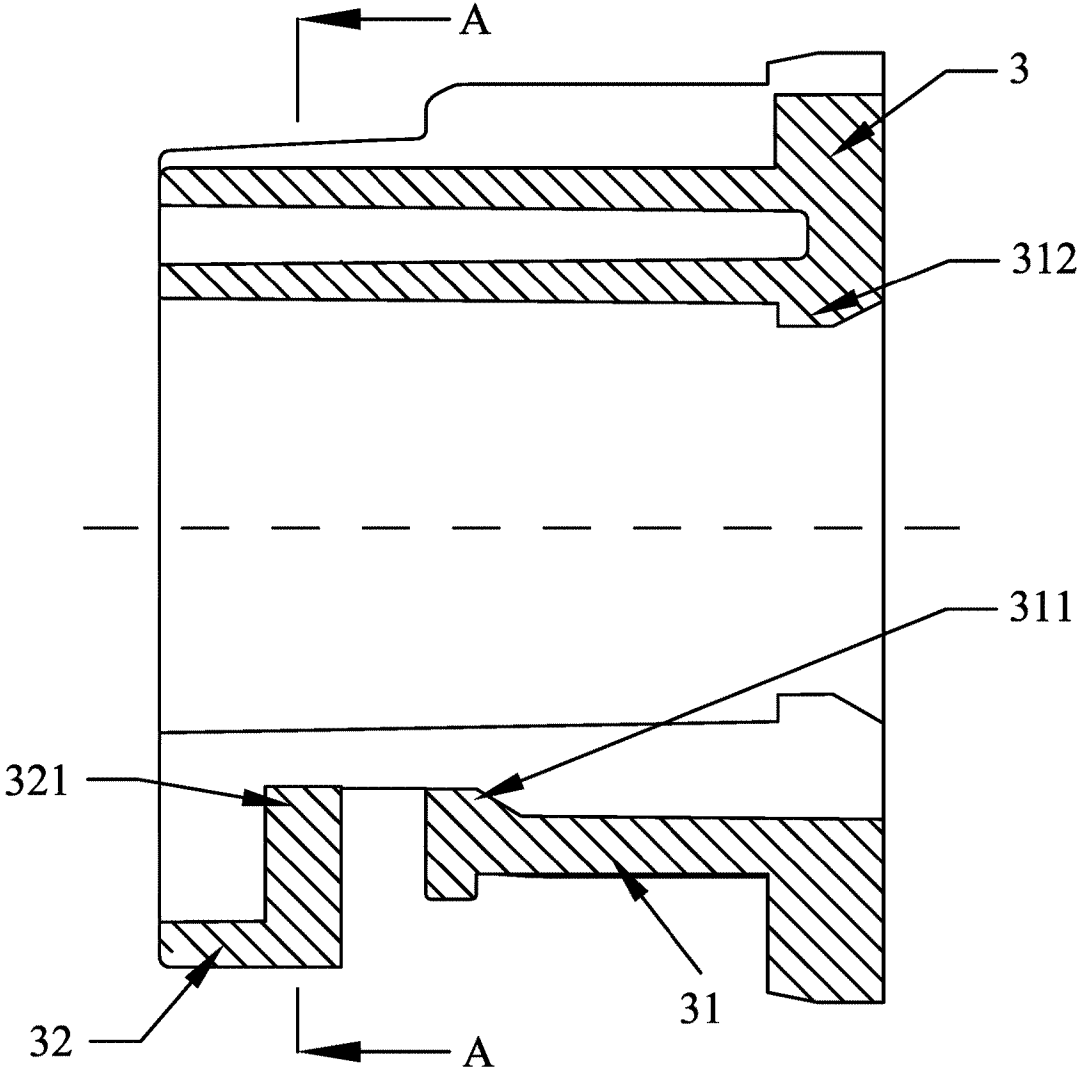
FIG. 3 is a sectional view of an elastic mechanism as described in the disclosure.
Figure 4:
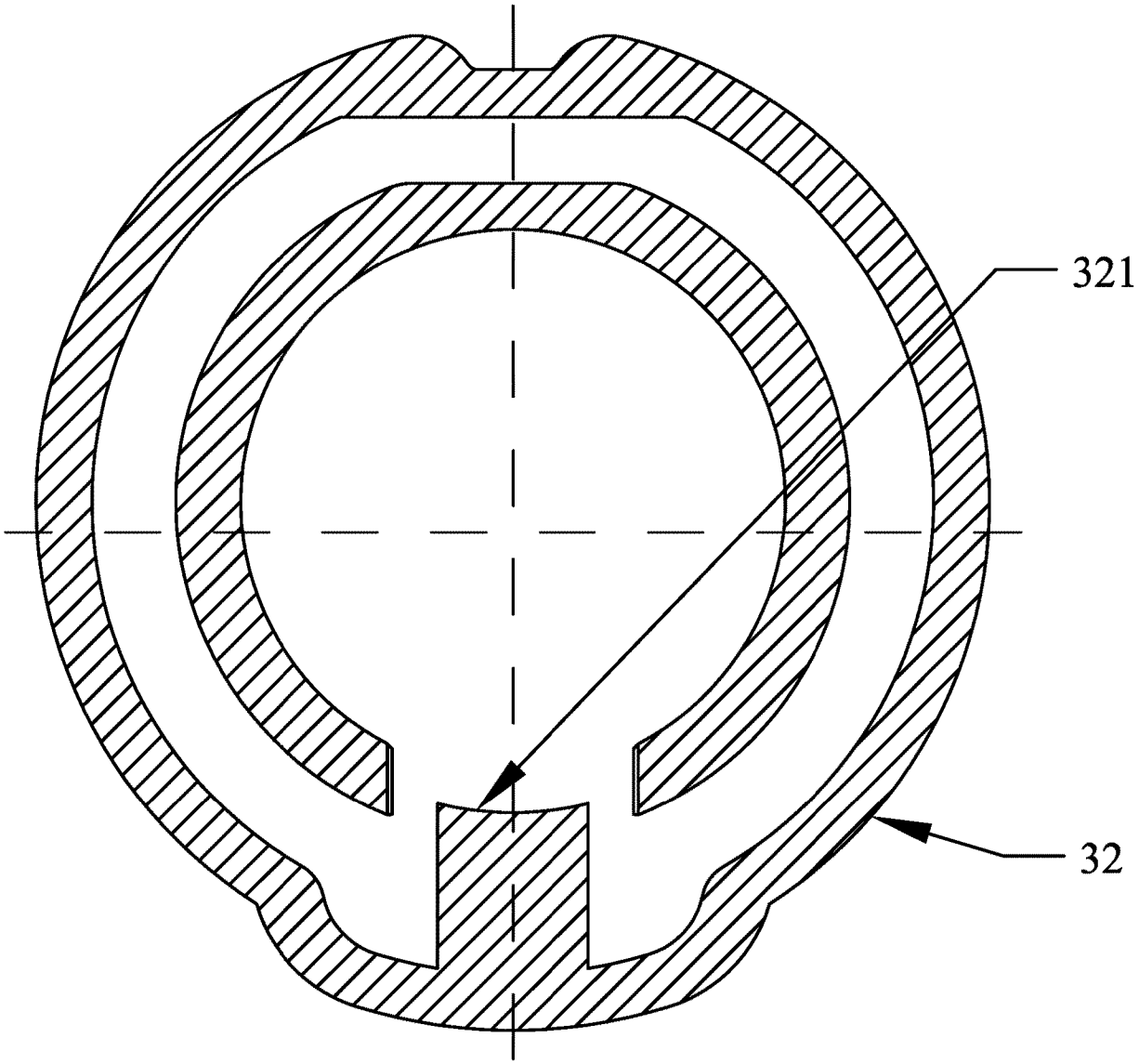
FIG. 4 is a sectional view taken from line A-A in FIG. 3.
Figure 5:
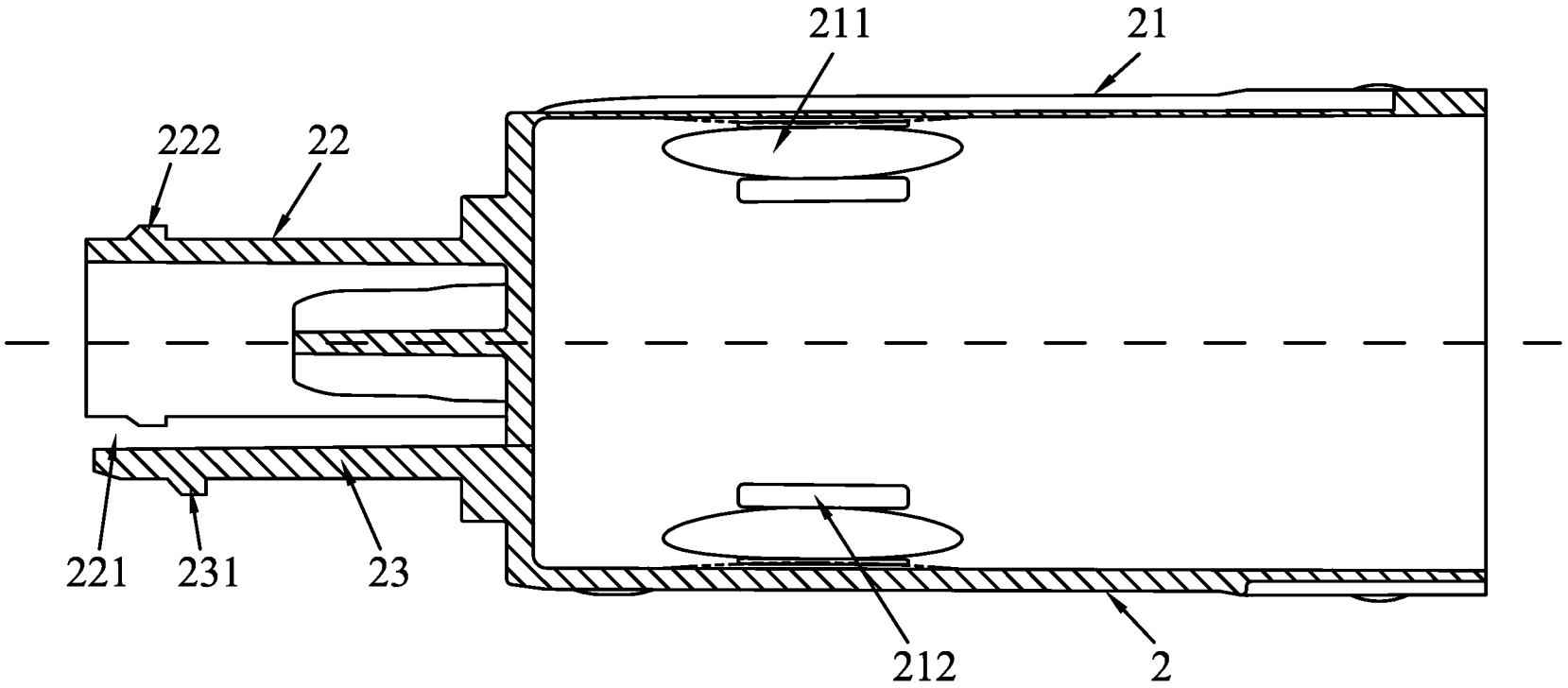
FIG. 5 is a schematic diagram of an inner sleeve of a cosmetic container as described in the disclosure.

In the drawings, the following reference numbers are used: 1. Tubular housing; 11. Button; 12. First groove; 13. Connection belt; 2. Inner sleeve; 21. Tube; 211. Fixing point; 212. Second groove; 22. Limit column; 221. Gap; 222. Second stopping point; 23. Elastic column; 231. First stopping point; 3. Elastic mechanism; 31. Annular body; 311. First clamping point; 312. Second clamping point; 32. Elastic ring; 321. Elastic press point; 33. Reset spring; 5. Middle assembly.

DETAILED DESCRIPTION

To further illustrate, embodiments detailing a press-type cosmetic container are described below. It should be noted that the following embodiments are intended to describe and not to limit the disclosure.

As shown in FIGS. 1-12, a press-type cosmetic container comprises a tubular housing 1; an inner sleeve 2 disposed in the tubular housing 1; and an elastic mechanism 3. The inner sleeve 2 comprises a first part, a second part, and a partition between the first part and the second part; the elastic mechanism 3 is disposed between the first part of the inner sleeve 2 and an inner wall of the tubular housing 1; the first part of the inner sleeve 2 is a hollow structure and comprises a limit column 22, an elastic column 23, and an axial gap 221 between the limit column 22 and the elastic column 23; the second part of the inner sleeve 2 comprises a tube 21 adapting to accommodate cosmetics; the tube 21 and the limit column 22 are disposed on the partition and extend axially towards two opposite directions; the elastic column 23 comprises an outer surface facing the elastic mechanism 3, and the outer surface of the elastic column 23 is provided with a first stopping point 231; the limit column 22 comprises an outer surface facing the elastic mechanism 3, and the outer surface of the limit column 22 is provided with a second stopping point 222; the elastic mechanism 3 comprises an annular body 31, an elastic ring 32 connected to the annular body 31, and a reset spring 33 disposed in the first part and connected to an inner end surface of the tubular housing; the annular body 31 and the elastic ring 32 sleeve the limit column 22 and the elastic column 23; the annular body 31 comprises a first clamping point 311 corresponding to the first stopping point 231 (the two parts cooperate to form a buckle) of the elastic column 23 and a second clamping point 312 corresponding to the second stopping point 222 of the limit column 22; the elastic ring 32 comprises an elastic press point 321 corresponding to the first stopping point 231; and the tabular housing comprises a button 11 corresponding to the elastic press point 321 of the elastic ring 32.

The tabular housing comprises a first groove 12 and the button 11 is disposed in the groove; the button 11 is connected of the tabular housing via a connection belt 13. The first groove and the button are square (other shapes can also be design as needed). The hollow structure of the first part is provided with an elastic limit part having a crisscross section for positioning the reset spring. The tube of the inner sleeve comprises at least one pair of fixing points 211 for fixing a middle assembly 5, and two sides of the at least one pair of fixing points 211 are provided with second grooves 212, thus ensuring the elasticity of the fixing points. The first stopping point 231 is disposed on the outer surface of one end of the elastic column towards the inner end surface of the tubular housing, and the second stopping point 222 is disposed on the outer surface of one end of the limit column towards the inner end surface of the tubular housing.

Figure 6:
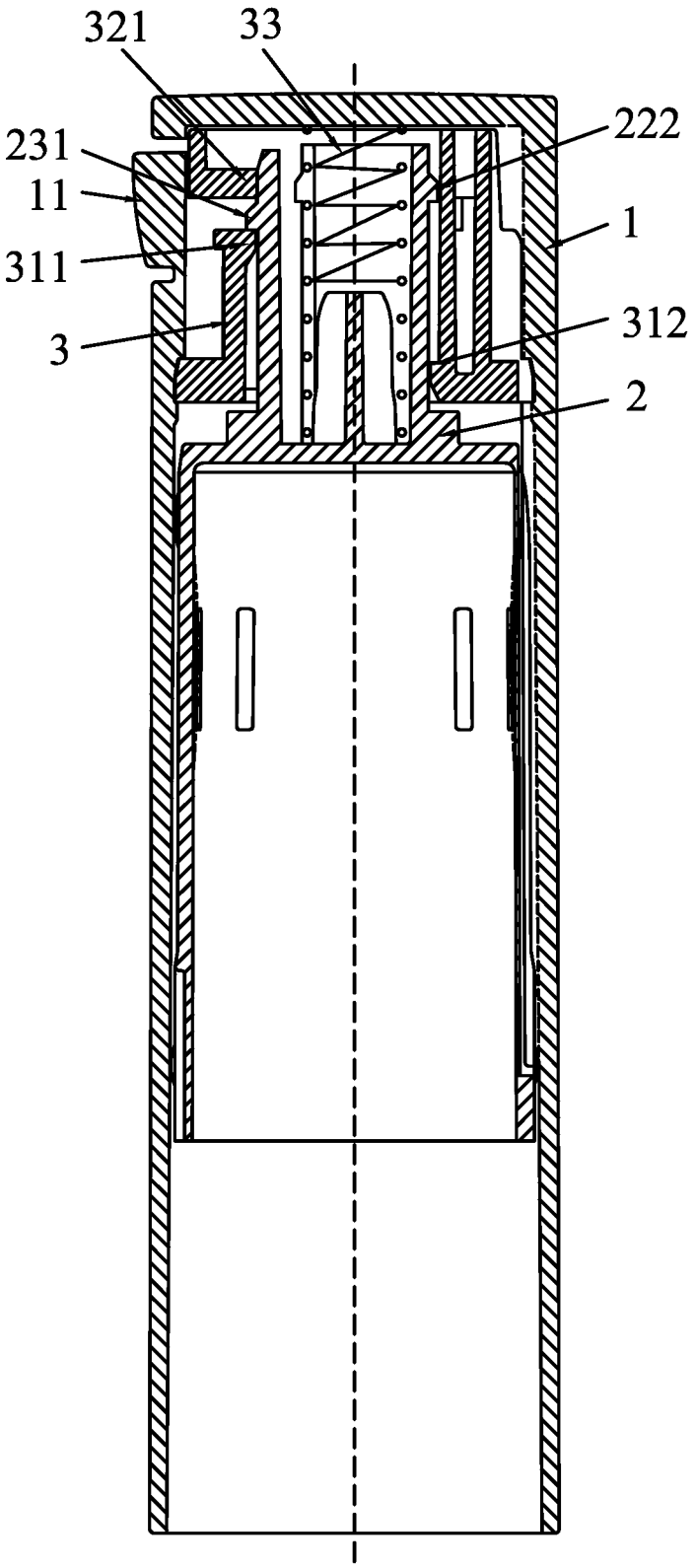
FIG. 6 is a schematic diagram of a cosmetic container as described in the disclosure.
Figure 7:
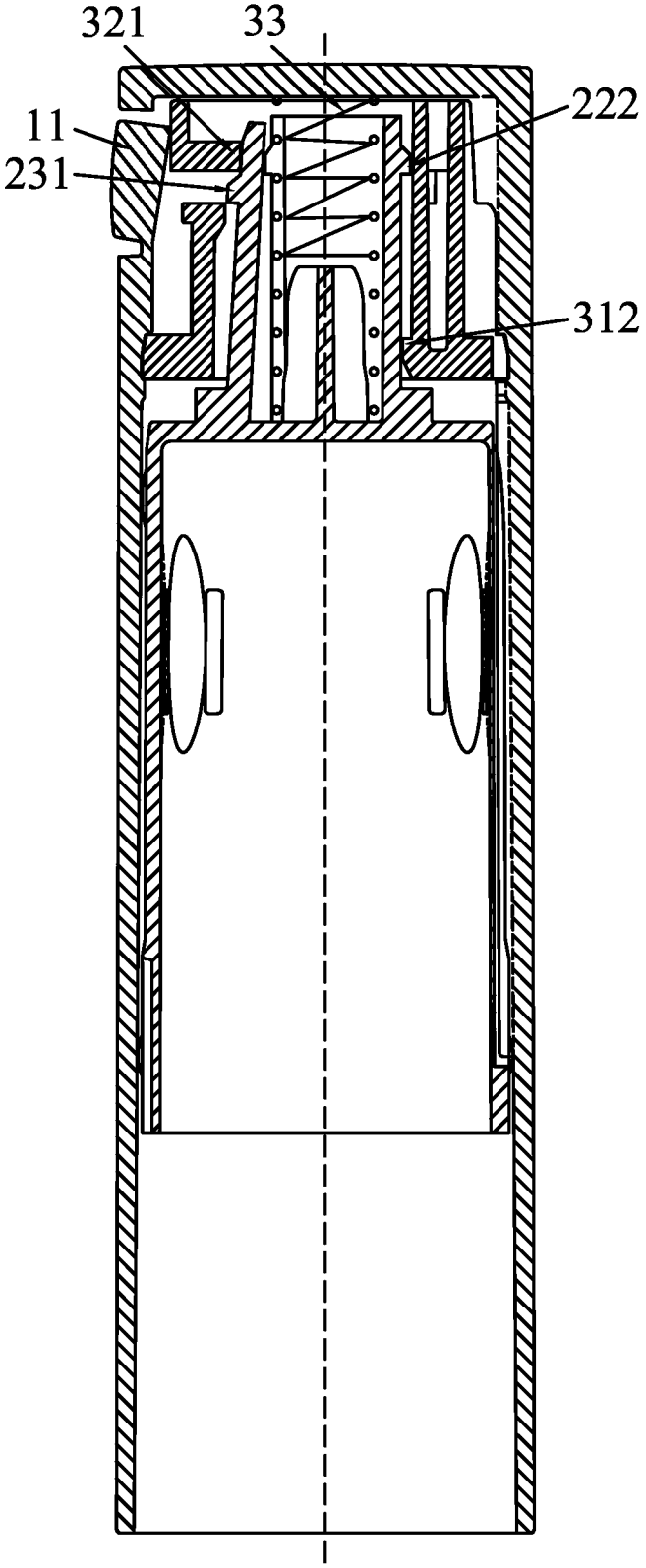
FIG. 7 is a state diagram of a cosmetic container in FIG. 6 upon pressing the button.
Figure 8:
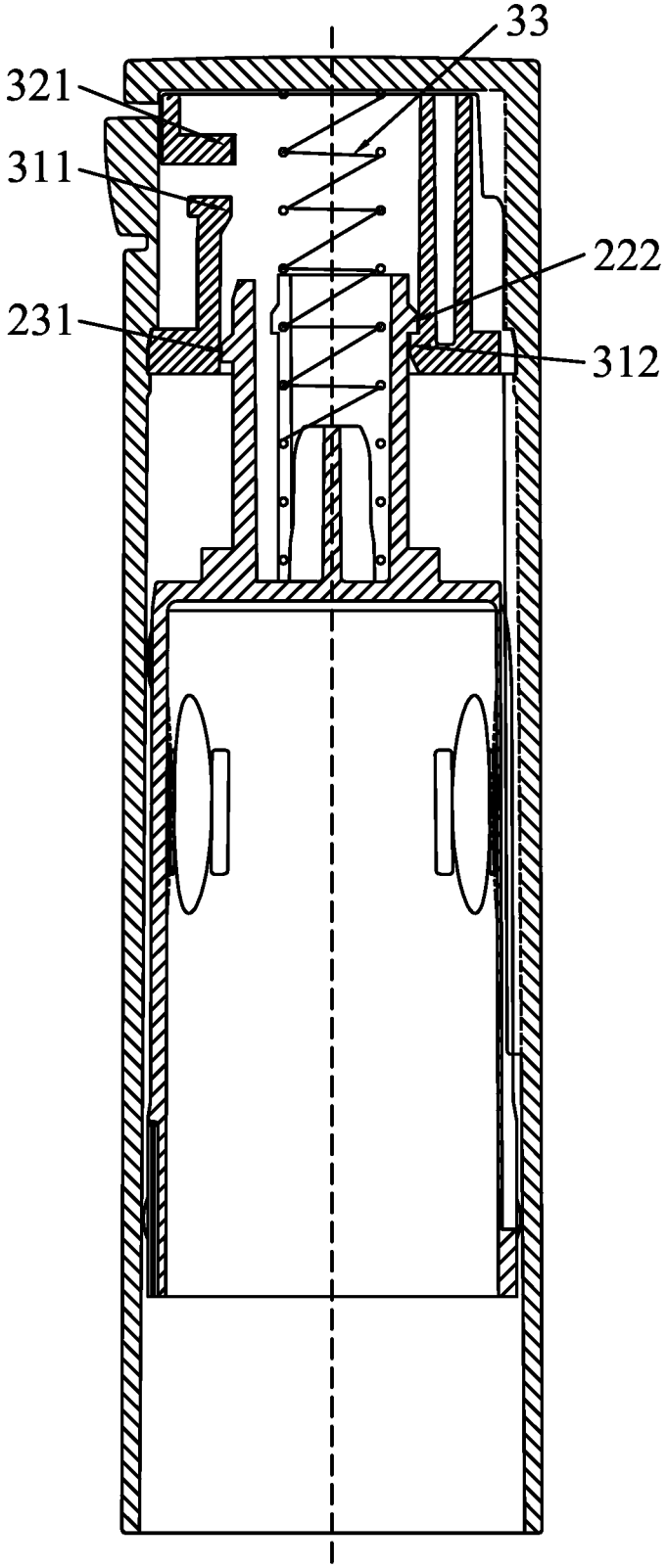
FIG. 8 is a state diagram of a cosmetic container in FIG. 6 after pressing the button.

FIG. 6 is a sectional view of the cosmetic container, in which the inner sleeve is pushed on the top of the tubular housing. Under this state, the first clamping point 311 is clamped and fixed by the first stopping point 231. When in use, press the button 11 of the tubular housing 1, the button 11 pushes the elastic press point 321 of the elastic mechanism 3 to move inwards, and the elastic press point 321 synchronously pushes the first stopping point 231 to move inwards. As a result, the first stopping point 231 detaches from the first clamping point 311, as shown in FIG. 7. Then, under the action of the reset spring 33, the inner sleeve 2 ejects outwards, until the second stopping point 222 clamps and fixes the second clamping point 312, as shown in FIG. 8.

Figure 9:
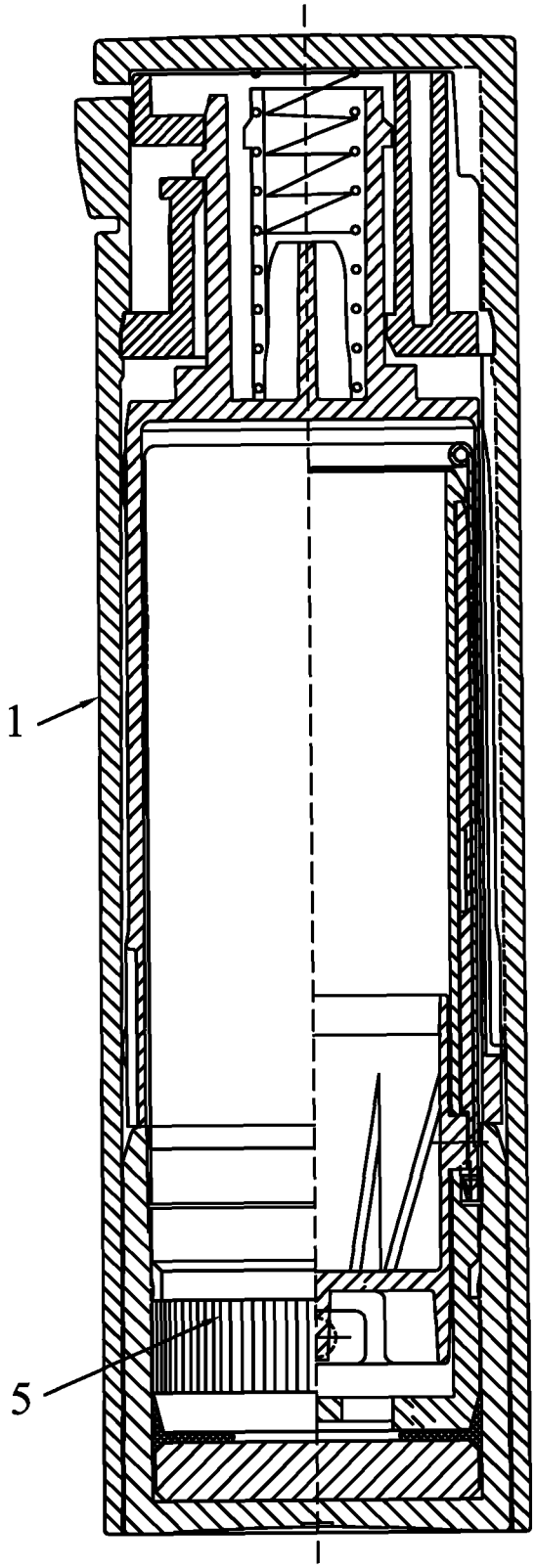
FIG. 9 is a sectional view of a combination of a middle assembly and a cosmetic container as described in the disclosure.
Figure 10:
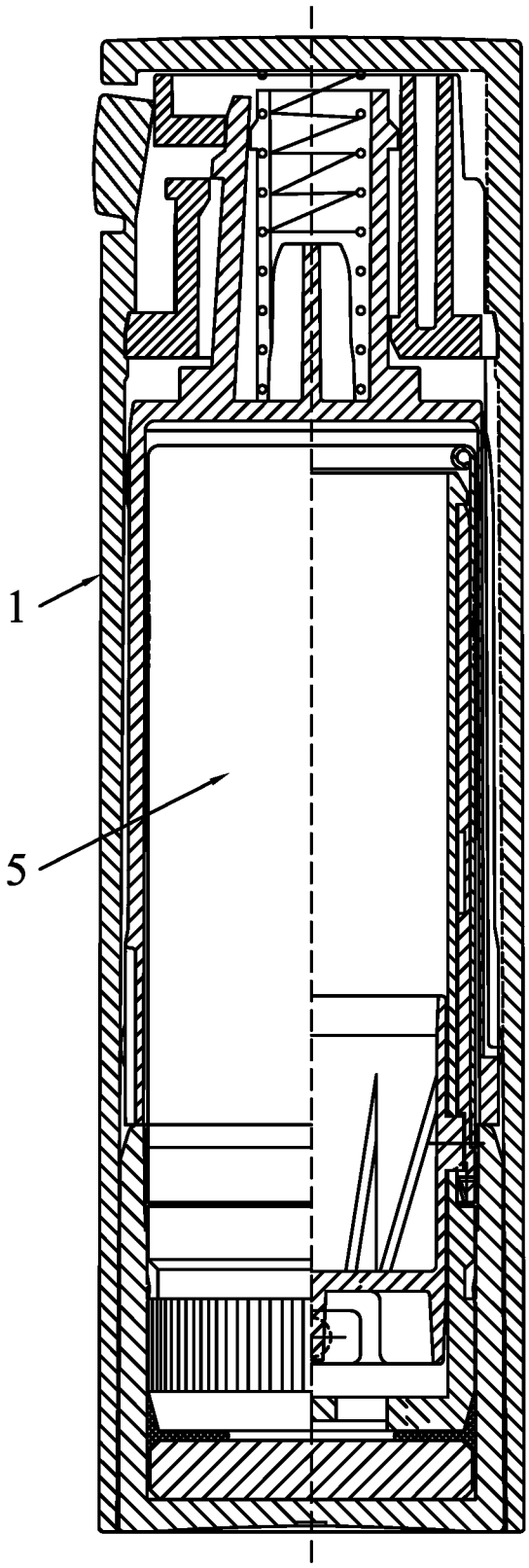
FIG. 10 is a state diagram of the combination in FIG. 9 upon pressing the button.
Figure 11:
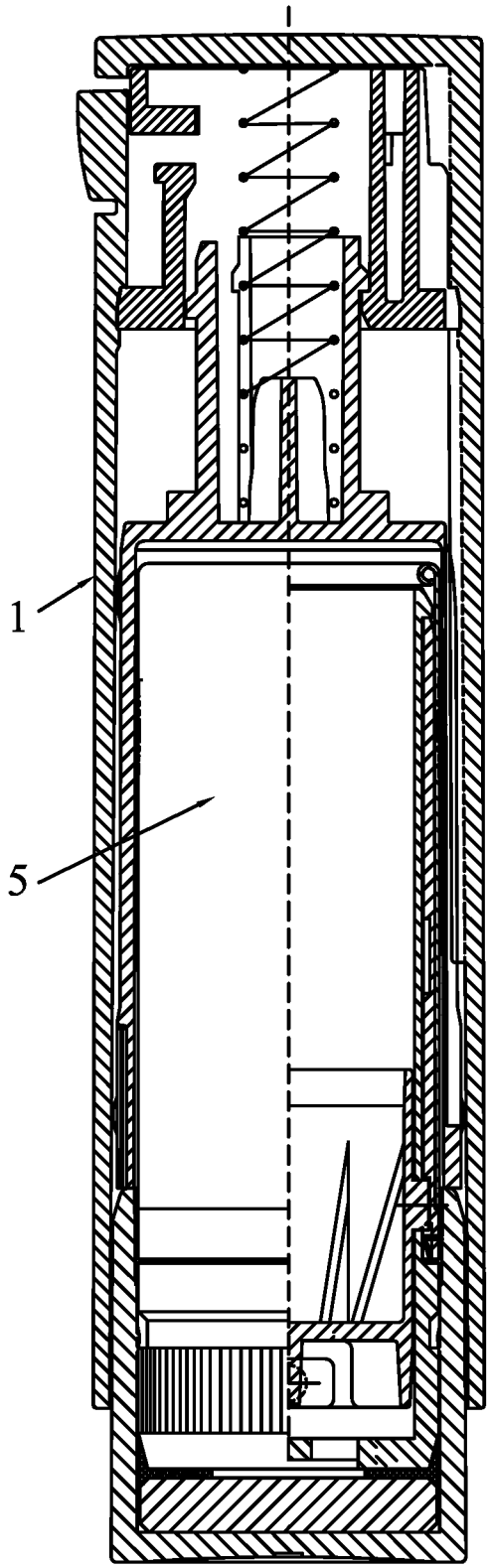
FIG. 11 is a state diagram of the combination in FIG. 9 after pressing the button.
Figure 12:
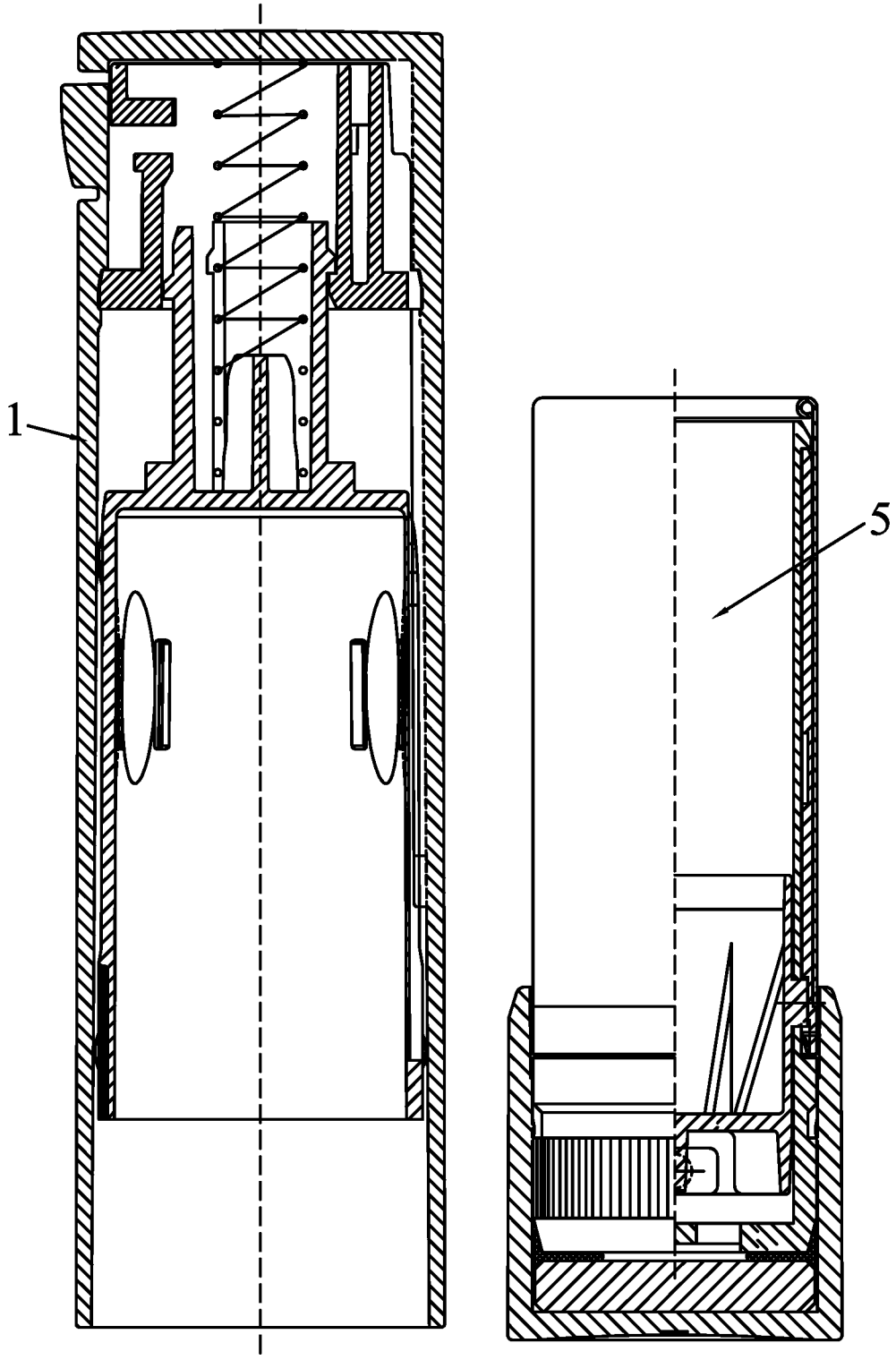
FIG. 12 is an exploded view of a middle assembly and a cosmetic container as described in the disclosure.

FIGS. 9-12 show the combination use of the cosmetic container and a middle assembly 5. In FIG. 9, the middle assembly tightly presses the tube of the inner sleeve, and the elastic mechanism and the inner sleeve are clamped with one another. When in use, as shown in FIG. 10, press the button on the tubular housing, the button pushes the elastic mechanism, and the elastic mechanism pushes the elastic column. The first stopping point detaches from the first clamping point. Thereafter, the reset spring ejects, the second stopping point clamps and fixes the second clamping point, as shown in FIG. 11. And then pull out the middle assembly and rotate the base for use, as shown in FIG. 12.

The button of the cosmetic container as described in the disclosure is integrated with the tubular housing. The cosmetic container has a simplified structure and is easy to operate.

It will be obvious to those skilled in the art that changes and modifications may be made, and therefore, the aim in the appended claims is to cover all such changes and modifications.

What is claimed is:

1. A cosmetic container, comprising:

a tubular housing;

an inner sleeve disposed in the tubular housing; and an elastic mechanism;

wherein:

the inner sleeve comprises a first part, a second part, and a partition between the first part and the second part;

the first part and the second part are disposed on the partition and extend axially towards two opposite directions;

the elastic mechanism is disposed between the first part of the inner sleeve and an inner wall of the tubular housing;

the first part of the inner sleeve is a hollow structure and comprises a limit column, an elastic column, and an axial gap between the limit column and the elastic column;

the second part of the inner sleeve comprises a tube adapting to accommodate cosmetics;

the elastic column comprises an outer surface facing the elastic mechanism, and the outer surface of the elastic column is provided with a first stopping point;

the limit column comprises an outer surface facing the elastic mechanism, and the outer surface of the limit column is provided with a second stopping point;

the elastic mechanism comprises an annular body, an elastic ring connected to the annular body, and a reset spring disposed in the first part and connected to an inner end surface of the tubular housing;

the annular body and the elastic ring sleeve the limit column and the elastic column;

the annular body comprises a first clamping point corresponding to the first stopping point of the elastic column and a second clamping point corresponding to the second stopping point of the limit column;

the elastic ring comprises an elastic press point corresponding to the first stopping point; and the tubular housing comprises a button corresponding to the elastic press point of the elastic ring.

2. The cosmetic container of claim 1, wherein the tubular housing comprises a first groove and the button is disposed in the groove; the button is connected of to the tubular housing via a connection belt.

3. The cosmetic container of claim 2, wherein the first groove and the button are square.

4. The cosmetic container of claim 1, wherein the hollow structure of the first part is provided with an elastic limit part having a crisscross section.

5. The cosmetic container of claim 1, wherein the tube of the inner sleeve comprises at least one pair of fixing points, and two sides of the at least one pair of fixing points are provided with second grooves.

6. The cosmetic container of claim 1, wherein the first stopping point is disposed on the outer surface of one end of the elastic column towards the inner end surface of the tubular housing, and the second stopping point is disposed on the outer surface of one end of the limit column towards the inner end surface of the tubular housing.

* * * * *